United States Patent [19]

Snapka

[11] Patent Number: 4,756,122

[45] Date of Patent: Jul. 12, 1988

[54] REMOVABLE WINDOW BAR

[76] Inventor: Charles J. Snapka, Box 193, Neches, Tex. 75779

[21] Appl. No.: 11,040

[22] Filed: Feb. 5, 1987

[51] Int. Cl.[4] ..... E06B 9/02

[52] U.S. Cl. ..... 49/57; 49/141; 292/190; 292/213

[58] Field of Search ..... 49/57, 141, 465, 56; 292/216, 213, 304, 190

[56] References Cited

U.S. PATENT DOCUMENTS

| | | | |
|---|---|---|---|
| 999,682 | 8/1911 | Suits | 49/57 |
| 1,543,755 | 6/1925 | Ebbesen | 292/190 |
| 2,222,667 | 11/1940 | Kitzelman | 49/57 |
| 2,924,862 | 2/1960 | Pellicore | 49/56 |
| 4,019,281 | 4/1977 | Weiler | 49/141 X |
| 4,057,935 | 11/1977 | Rohrberg et al. | 49/141 X |
| 4,059,413 | 11/1977 | Forgione | 49/56 |
| 4,249,345 | 2/1981 | Littleton | 49/141 X |
| 4,452,011 | 6/1984 | Trombettas | 49/56 |
| 4,677,791 | 6/1987 | Larson et al. | 49/57 X |

*Primary Examiner*—Philip C. Kannan
*Attorney, Agent, or Firm*—John M. Harrison

[57] ABSTRACT

A removable window bar for mounting inside a window structure, which window bar is characterized by a parallel top and bottom bar and crossbar, spaced by vertical bars. The bottom bar is removably seated in a pair of bar seats fastened in oppositely disposed relationship to the window facing. A pair of latch stays are also mounted in the window facing above and in spaced relationship with respect to the bar seats, respectively, and a rotatable latch is provided on each of the extending ends of the top bar, which latch is designed to removably engage the latch stay on each window facing and removably secure the removable window bar in position in the window. Rotational manipulation of each latch facilitates removal of the latch from the companion latch stay and lifting of the removably window bar from the bar seats, in order to remove the removable window bar from the window.

20 Claims, 1 Drawing Sheet

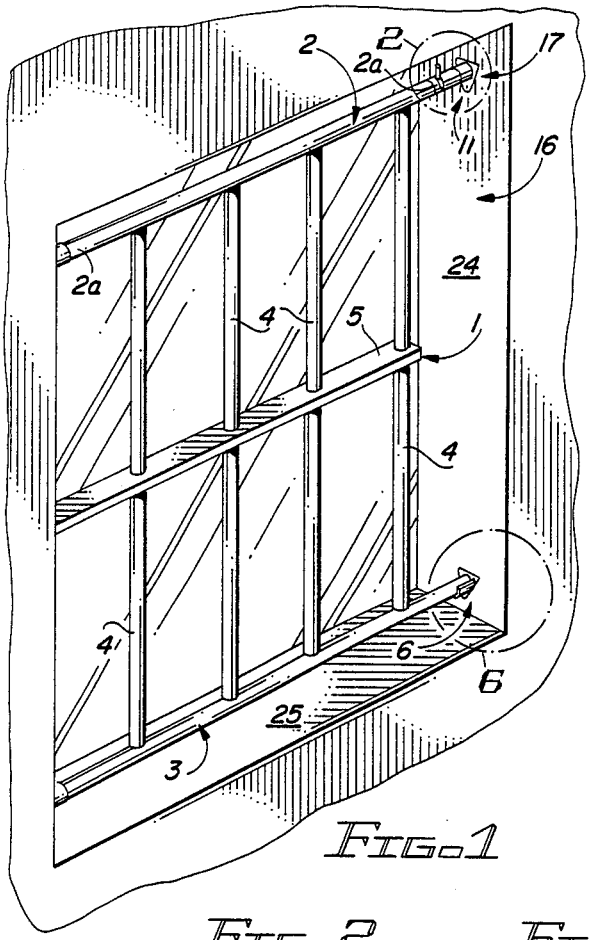
FIG. 1
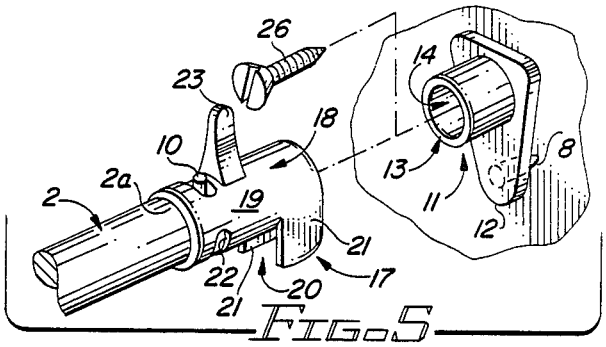
FIG. 5
FIG. 6
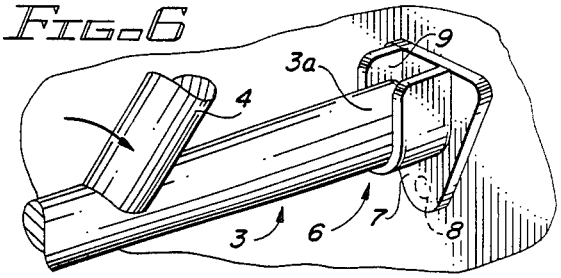
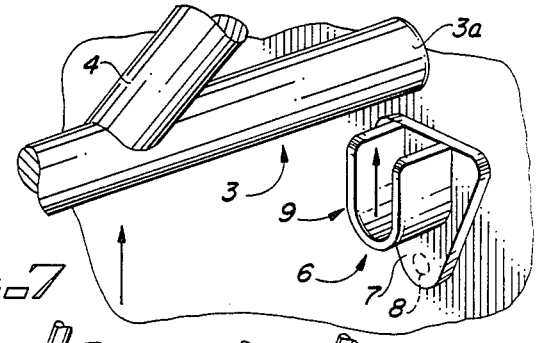
FIG. 7
FIG. 2
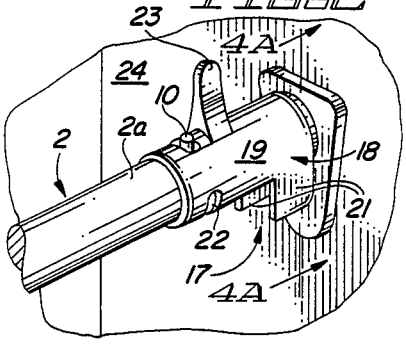
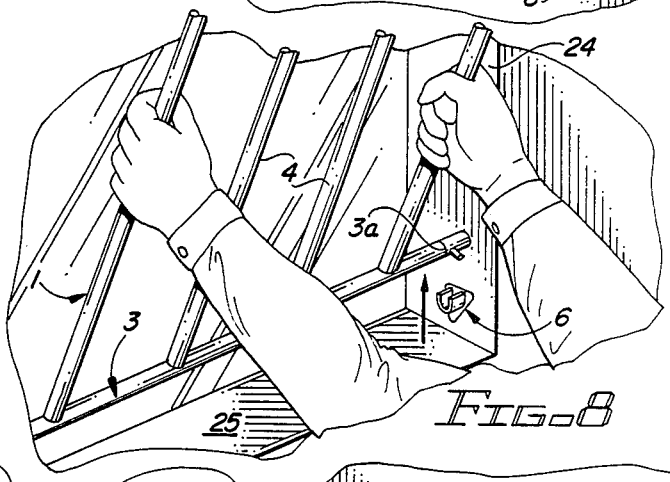
FIG. 8
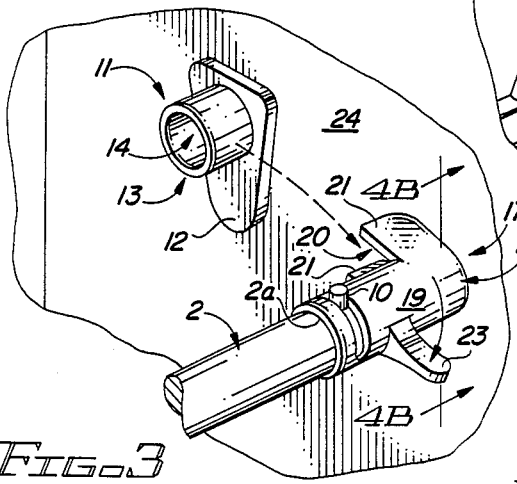
FIG. 3
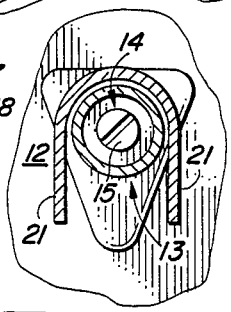
FIG. 4A
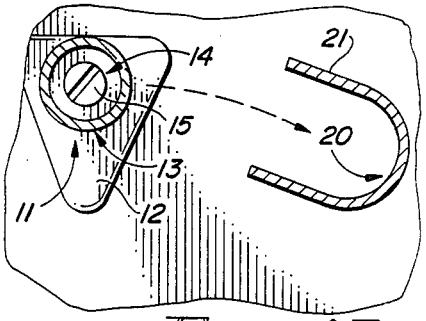
FIG. 4B

REMOVABLE WINDOW BAR

BACKGROUND OF THE INVENTION

1. Field of the Invention

An increasing problem in our society today is that of burglary and breaking and entering of dwellings and other structures. A high percentage of such burglaries and intrusions occur through the windows of these structures, many times by simply opening unlocked windows or breaking the windows and releasing the window latches. The windows are also sometimes forced with a crowbar or other tool, in order to break the locks, if locks are provided on the windows.

This invention relates to a new and improved security closure system for windows and more particularly, to a removable window bar for closing windows, which removable window bar is characterized by spaced bar seats for supporting the window bar and cooperating latch stay and companion latch mechanisms for removably securing the removable window bar in the window. In a preferred embodiment, the removable window bar is characterized by parallel top and bottom bars spaced by vertically oriented vertical bars, with a cross bar acting as a stiffener between the vertical bars and the bottom bar seated in a pair of spaced bar seats attached to the window facing. A pair of latch stays are also fastened to the window facing above and in spaced relationship with respect to the bar seats, respectively, and a rotatable latching mechanism is provided on the extending ends of the top bar, in order to removably secure the top bar to the latch stays. In a most preferred embodiment of the invention, the latch stays are each further characterized by a stay flange secured to the window facing and an extending cylinder which is designed to engage the barrel portion of a corresponding latch housing. The barrel portion of the latch housing is rotatable on the top bar into a first position wherein the top bar is fixed with respect to the latch stay and into a second position wherein the top bar is releasable from the latch stays, such that the removable window bar can be lifted from contact with the bar seats and removed from the window.

2. Description of the Prior Art

Various types of guards and other security devices for windows are known in the art. An early "Combined Guard And Screen For Windows" is disclosed in U.S. Pat. No. 999,682, dated Aug. 1, 1911, to B. C. Suits. This patent details a pair of slotted, vertically-oriented members mounted to the window and a barred closure member closing the window by engaging the slots to removably secure the window against intruders. A "Securing Means For Window Guards and the Like" is disclosed in U.S. Pat. No. 2,924,862, dated Feb. 16, 1960, to A. P. Pellicore. The Pellicore device includes a stop member which is rotatably mounted adjacent a panel member that is hinged over a window flange secured to the building wall adjacent the window and a resilient member urging the stop member toward the free edge. This arrangement insures that the panel member is maintained in closed relationship by resilient engagement of the flange member between the panel member and the stop member. The device further includes a locking means extending transversely from the stop member into the building opening or window and engagable by a secondary closure member, whereby the stop member is restrained against rotation. U.S. Pat. No. 4,019,281, dated Apr. 26, 1977, to Ray C. Weiler, discloses a quick-release window guard. The window guard detailed in this patent includes an external steel grating which is provided with seven vertical bars welded at their ends to upper and lower horizontal, hollow cross bars, the end portions of which cross bars are bent rearwardly and secured to a building, such that the grating overlies a window opening and protects it against illegal entry. One end of the grating is provided with a loosely hinged connection with the building and the cross bars are jointed near the opposite end of the grating and locked into assembled relationship by a hidden bolt provided in one of the crossbars. A cable from the bolt extends through the crossbar to the interior of the building and when pulled, the cable withdraws the bolt from a locking position and frees the joints for separation by gravity, allowing the major hinged portion of the grating to swing freely outwardly and afford a ready escape from the building through the window. A "Window Security Apparatus" is disclosed in U.S. Pat. No. 4,059,413, dated Nov. 22, 1977, to Joseph Forgione. The window security apparatus of this patent is designed for attachment to the interior side of conventional residential window structures. It includes a horizontal bar having multiple vertical bars fixed thereto, the vertical bars of which are slidably mounted in respective apertures suitably provided in the seal of the window. Accordingly, the bars may be slidably moved upwardly to a security position which blocks the window and downwardly to an escape position which provides access through the window. A lock structure is included to lock the bars in the security position and a lock trip/-release device allows the lock structure to release, which causes the bars to gravitate downwardly to the escape position, thus enabling the occupants of a building to escape through the window in the event of fire. U.S. Pat. No. 4,057,935 dated Nov. 15, 1977, to Rod G. Rohrberg, et al, discloses a "Quick Release Mechanism for Window Guard or The Like." This device is characterized by a retainer member which is fixedly attached to a window or door and is adapted to releasably engage a latching mechanism retained on the wall adjacent to the window or door frame. The latching mechanism includes an interlatching member which is attached to a slidably mounted rod and an outer retainer collet which, when manipulated into the latch position, retains the latching member within the retainer member. A spring is placed between the inner latching member and the retainer member and is compressed when the mechanism is in the latched configuration. The mechanism is unlatched by means of a knob located adjacent the inner wall surrounding the window frame, the knob being attached to the rod connected to the inner latching member. Inward actuation of the knob moves the inner latching member away from the retainer collet against the spring to release the latching mechanism, the spring and actuation by the operator then driving the grill away from the window. U.S. Pat. No. 4,249,345, dated Feb. 10, 1981, to Ricky V. Littleton, discloses a "Releasable Window Guard", which is characterized by a guard mounted to a window frame for covering the window. The guard is pivotally mounted and a locking mechanism selectively prevents pivoting of the guard. A latch member controls the locking mechanism and an enclosure is formed around the latch member to prevent access from the exterior. The enclosure has an opening that faces the interior and a pair of doors are located at the opening, one with a vertical hinge and the other with a horizontal hinge. Both of these doors require opening to reach the latch member and when opened, the doors form a barrier in cooperation with the window frame which requires the intruder to attempt to reach around the doors in order to reach the latch member. A "Grill-Type Window Gate Apparatus" is disclosed in U.S. Pat. No. 4,452,011, dated June 5, 1984, to David T. Trombettas. The device detailed in this patent includes a frame which is mounted in a window opening and a grillwork panel which is movably mounted on the frame. A panel lock assembly is mounted on the grillwork panel and is capable of locking the panel to the frame when the panel is in a closed position. A window lock assembly is mounted on the frame and engages the grillwork panel when the panel is in the closed position, thereby locking a window assembly which is mounted in the window opening.

The invention will be better understood by reference to the accompanying drawing, wherein:

FIG. 1 is a perspective view of the removable window bar in functional, closed position mounted in the window of a structure;

FIG. 2 is a perspective detail of a latch mechanism in secured configuration, for securing the removable window bar in the position illustrated in FIG. 1;

FIG. 3 is a detail of the latch mechanism illustrated in FIG. 2 in released configuration, more particularly illustrating the cooperating latch stay and latch;

FIG. 4A is a sectional view of the latch mechanism in closed configuration, taken along line 4A—4A in FIG. 2; and FIG. 4B is a sectional view taken along line 4B—4B, of the latch mechanism and latch stay illustrated in FIG. 3.

FIG. 5 is a perspective, exploded view of the latch housing to latch stay connection;

FIG. 6 is a perspective view, partially in section, of the bottom bar to bar seat connection;

FIG. 7 is a perspective view, partially in section, of the bottom bar to bar seat connection with the bottom bar removed from the bar seat; and FIG. 8 is a perspective view, partially in section, of the removable window bar being removed from one of the bar seats illustrated in FIGS. 6 and 7.

DESCRIPTION OF THE PREFERRED EMBODIMENTS

Referring initially to FIG. 1 of the drawing the removable window bar of this invention is generally illustrated by reference numeral 1. The removable window bar 1 is characterized by a top bar 2, with extending top bar ends 2*a*, a bottom bar 3, spaced from the top bar 2 in parallel relationship and multiple, vertical bars 4 extending between the top bar 2 and the bottom bar 3. A flat cross bar 5 extends between the top bar 2 and the bottom bar 3 in parallel relationship and serves to stiffen and strengthen the vertical bars 4, as illustrated. The removable window bar 1 is mounted between the window facings 24 and above the window sill 25 of a window 16, by means of a pair of facing bar seats 6 secured to the window facings 24 and a pair of companion latch stays 11, also secured to the window facings 24, as hereinafter described.

Referring now to FIGS. 1 and 5 of the drawing, each latch stay 11 is characterized by a flat stay flange 12 which fits against a window facing 24, respectfully, with a mount stud 8 projecting rearwardly of the stay flange 12 for penetrating the window facing 24 and stabilizing the stay flange 12 tightly against the window facing 24. A stay cylinder 13 projects from the stay flange 12 in fixed relationship and is provided with a central cylinder bore 14, which receives a screw 26, as illustrated. The stay flange 12 is provided with a hole (not illustrated) which receives the threaded shank of the screw 26 and facilitates mounting of each of the latch stays 11 to the window facings 24, respectively. A latch 17 is designed to rotatably fit on each of the top bar ends 2*a* of the top bar 2 and each latch 17 is characterized by a cylindrically-shaped latch housing 18, provided with a downwardly extending, open-ended trough flange 21. The trough flange 21 is further provided with a barrel slot 22, which extends approximately two-thirds of the way through the housing barrel 19 inwardly of the outwardly projecting grip 23. A pin 10 projects outwardly in transverse relationship from each of the top bar ends 2*a* and extends through the barrel slot 22, in order to rotatably maintain each latch 17 on one of the top bar ends 2*a*, respectively. Accordingly, each latch 17 is rotatably secured to a top bar end 2*a* of the top bar 2 by means of a pin 10 and is able to rotate throughout the full length of the barrel slot 22 by manipulation of the grip 23.

Referring now to FIGS. 1, 6 and 7 of the drawing, each of the two facing bar seats 6 is further characterized by a flat seat flange 7, which is shaped substantially in the same configuration as the stay flange 12 of the latch stay 11 and is also provided with a mount stud 8. A saddle 9 projects outwardly from the seat flange 7 of each of the bar seats 6 and is open upwardly to receive the bottom bar ends 3*a* of the bottom bar 3. Accordingly, as hereinafter described and as illustrated in FIG. 7, the bottom bar ends 3*a* of the bottom bar 3 can be lifted free of the saddles 9 respectively, when each latch 17 is released from a companion latch stay 11.

Referring now to FIGS. 3, 4A, 4B, 7 and 8, the removable window bar 1 of this invention is secured and removed as follows. As illustrated in FIG. 1, when it is desired to remove the removable window bar 1 from the window 16, the grip 23 in each latch 17 is grasped and rotated downwardly and inwardly from the position illustrated in FIG. 2 to the position illustrated in FIG. 3. This manuever also rotates the trough flange 21 in each latch 17 to the position illustrated in 3, wherein each latch 17 is allowed to slip from the corresponding stay cylinder 13 and the latch stay 11, by virtue of the open position of the barrel trough 20. Since the bottom bar ends 3*a* are seated in the saddles 9 of the bar seats 6, respectively, the removable window bar 1 can be rotated inwardly as illustrated in FIG. 8 and freed from each bar seat 6 by simply lifting the entire removable window bar 1 upwardly, also as illustrated in FIG. 8. This manipulation of the removable window bar 1 away from the window 16 provides quick and easy access to the window 16 in the event of fire or other emergency. In order to replace the removable window bar 1 in the window 16, it is only necessary to again seat the bottom bar ends 3*a* in the saddle 9 of each of the bar seats 6 and again rotate the top bar 2 upwardly to effect registration of the barrel troughs 20 with the stay cylinders 13, respectively. The housing barrel 19 of each of the latch housings 18 is then rotated throughout the length of the barrel slot 22 by manipulation of the grip 23 upwardly, in order to again face the trough flanges downwardly, as illustrated in FIGS. 1, and 2 and lock the removable window bar 1 in the window 16.

It will be appreciated by those skilled in the art that the removable window bar 1 of this invention affords an inexpensive, yet secure means for closing the window of a structure. Since the removable window bar 1 is mounted inside of the glass panels in the window 16, it is necessary to break the window in order to provide access to each latch 17, manipulate the grips 23 and remove the removable window bar 1 from the outside. Such a procedure is highly unlikely in light of the noise involved in breaking the window pane and the time required to gain entry by such a measure.

It will be further appreciated by those skilled in the art that the removable window bar 1 can be utilized in homes, offices and other structures where burglaries and break-ins present a problem. Furthermore, the removable window bar 1 can be constructed of flat or round bar stock, according to the knowledge of those skilled in the art. Additionally, the latch 17, latch stay 11 and the bar seat 6 can also be constructed of either cast or shaped metal, preferably steel, further according to the knowledge of those skilled in the art.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A removable window bar for a window having a window facing, comprising a top bar, a bottom bar provided in spaced, parallel relationship with respect to said top bar; at least two vertical bars connecting said top bar and said bottom bar; bar seat means attached to the window facing for supporting said bottom bar; a pair of latch stays attached to the window facing in facing relationship above said bar seat means and a stay cylinder provided in each of said latch stays, respectively; a latch rotatably carried by each end of said top bar and a barrel trough provided in said latch, whereby said latch slectively engages and disengages said stay cylinder in said latch stay, respectively, responsive to rotation of said latch with respect to said stay cylinder, respectively.

2. The removable window bar of claim 1 further comprising a grip projecting from said latch for manipulating said latch into engaging and disengaging configuration with said stay cylinder.

3. The removable window bar of claim 1 further comprising a slot provided in said latch and a pin fixedly secured to each end of said top bar in transverse relationship, said pin extending through said slot and limiting the rotation of said latch and said trough flange with respect to said top bar.

4. The removable window bar of claim 1 further comprising:

(a) a grip projecting from said latch for manipulating said latch into engaging and disengaging configuration with said stay cylinder; and (b) a slot provided in said latch and a pin fixedly secured to each end of said top bar in transverse relationship, said pin extending through said slot and limiting the rotation of said latch and said trough flange with respect to said top bar.

5. The removable window bar of claim 1 wherein said bar seat means further comprises a pair of facing bar seats, each of said bar seats having a stay flange for securing said bar seats to the window facing and an outwardly projecting saddle for removably receiving the ends of said bottom bar, respectively.

6. The removable window bar of claim 5 further comprising a grip projecting from said latch for manipulating said latch into engaging and disengaging configuration with said stay cylinder.

7. The removable window bar of claim 5 further comprising a slot provided in said latch and a pin fixedly secured to each end of said top bar in transverse relationship, said pin extending through said slot and limiting the rotation of said latch and said trough flange with respect to said top bar.

8. The removable window bar of claim 5 further comprising:

(a) a grip projecting from said latch for manipulating said latch into engaging and disengaging configuration with said stay cylinder; and (b) a slot provided in said latch and a pin fixedly secured to each end of said top bar in transverse relationship, said pin extending through said slot and limiting the rotation of said latch and said trough flange with respect to said top bar.

9. The removable window bar of claim 1 wherein said stay cylinder in said latch stays is hollow and further comprising a hole provided in each of said latch stays, said hole situated substantially in registration with said hollow in said stay cylinder and a screw provided in registration with said hole and said hollow for securing said latch stays to the window facing.

10. The removable window bar of claim 9 wherein said bar seat means further comprises a pair of facing bar seats, each of said bar seats having a stay flange for securing said bar seats to the window facing and an outwardly projecting saddle for removably receiving the ends of said bottom bar, respectively.

11. The removable window bar of claim 10 further comprising a grip projecting from said latch for manipulating said latch into engaging and disengaging configuration with said stay cylinder.

12. The removable window bar of claim 10 further comprising a slot provided in said latch and a pin fixedly secured to each end of said top bar in transverse relationship, said pin extending through said slot and limiting the rotation of said latch and said trough flange with respect to said top bar.

13. The removable window bar of claim 10 further comprising:

(a) a grip projecting from said latch for manipulating said latch into engaing and disengaging configuration with said stay cylinder; and (b) a slot provided in said latch and a pin fixedly secured to each end of said top bar in transverse relationship, said pin extending through said slot and limiting the rotation of said latch and said trough flange with respect to said top bar.

14. A removable window bar for installation in a window having vertically opposed window facings, said window bar comprising a top bar; a bottom bar provided in spaced, parallel relationship with respect to said top bar; at least two vertical bars connecting said top bar and said bottom bar in spaced relationship; a first bar seat secured to one of the window facings and a second bar seat secured to the other of said window facing opposite said first bar seat, whereby the ends of said bottom bar are removably seated in said first bar seat and said second bar seat, respectively; a first latch stay secured to one of the window facings above and in spaced relationship with respect to said first bar seat and a first stay cylinder projecting from said first latch stay; a second latch stay secured to the other one of the window facings above and in spaced relationship with respect to said second bar seat and a second stay cylinder projecting from said second latch stay; a first latch rotatably carried by one end of said top bar and a first barrel trough provided in said first latch for selectively engaging said first stay cylinder; and a second latch rotatably carried by the opposite end of said top bar and a second barrel trough provided in said second latch for selectively engaging said second stay cylinder, whereby said first latch selectively engages and disengages said first stay cylinder and said second latch selectively engages and disengages said second stay cylinder, respectively, responsive to rotation of said first latch and said second latch on said one end and said opposite end of said top bar, respectively.

15. The removable window bar of claim 14 further comprising a first grip projecting from said first latch and a second grip projecting from said second latch for manipulating said first latch and said second latch into engaging and disengaging configuration with said first stay cylinder and said second stay cylinder, respectively.

16. The removable window bar of claim 14 further comprising a first slot provided in said first latch; a first pin fixedly secured in said one end of said top bar in transverse relationship, said first pin extending through said first slot and limiting the rotation of said first latch on said one end of said top bar; and a second slot provided in said second latch; a second pin fixedly secured in said opposite end of said top bar in transverse relationship, said second pin extending through said second slot and limiting the rotation of said second latch on said opposite end of said top bar.

17. The removable window bar of claim 14 wherein said first bar seat and said second bar seat are each further characterized by a seat flange for securing said first bar seat and said second bar seat to the window facings, respectively, and an outwardly-projecting saddle carried by said seat flange for removably receiving said ends of said bottom bar, respectively.

18. The removable window bar of claim 14 further comprising:

(a) a first grip projecting from said first latch and a second grip projecting from said second latch for manipulating said first latch and said second latch into engaging and disengaging configuration with said first stay cylinder and said second stay cylinder, respectively; and (b) a first slot provided in said first latch; a first pin fixedly secured in said one end of said top bar in transverse relationship, said first pin extending through said first slot and limiting the rotation of said first latch on said one end of said top bar; and a second slot provided in said second latch; a second pin fixedly secured in said opposite end of said top bar in transverse relationship, said second pin extending through said second slot and limiting the rotation of said second latch on said opposite end of said top bar.

19. The removable window bar of claim 18 wherein said first bar seat and said second bar seat are each further characterized by a seat flange for securing said first bar seat and said second bar seat to the window facings, respectively, and an outwardly-projecting saddle carried by said seat flange for removably receiving said ends of said bottom bar, respectively.

20. The removable window bar of claim 19 wherein said first stay cylinder and said second stay cylinder are hollow and further comprising a hole provided in said first latch stay and said second latch stay, respectively, said hole provided substantially in registration with said hollow and a screw provided in said hole and said hollow, respectively, for securing said first latch stay and said first stay cylinder to one of the window facings and said second latch stay and said second stay cylinder to the other of the window facings.

* * * * *